US008291516B2

(12) United States Patent
Chen

(10) Patent No.: US 8,291,516 B2
(45) **Date of Patent: *Oct. 23, 2012**

(54) GLOVE

(76) Inventor: Yi-Yi Chen, Changhua Hsien (TW)

( * ) Notice: Subject to any disclaimer, the term of this patent is extended or adjusted under 35 U.S.C. 154(b) by 226 days.

This patent is subject to a terminal disclaimer.

(21) Appl. No.: 12/773,339

(22) Filed: May 4, 2010

(65) Prior Publication Data

US 2011/0113527 A1 May 19, 2011

(30) Foreign Application Priority Data

Nov. 17, 2009 (TW) ..... 98221340 U

(51) Int. Cl.
*A41D 19/00* (2006.01)

(52) U.S. Cl. ..... 2/160; 2/161.1

(58) Field of Classification Search ..... 2/158, 159, 2/160, 161.1, 161.2, 161.3, 161.4, 161.5, 2/161.6, 162, 166, 167, 168, 165, 267, 20, 2/170; 362/103

See application file for complete search history.

(56) References Cited

U.S. PATENT DOCUMENTS 1,398,273 A * 11/1921 Peszternak ..... 2/209.14
1,453,671 A * 5/1923 Harrold ..... 359/871
1,612,055 A * 12/1926 Rice ..... 2/160
1,966,822 A * 7/1934 Lieb ..... 359/517
2,265,094 A * 12/1941 Wolfe ..... 359/879
3,717,403 A * 2/1973 Messier ..... 359/879
D236,458 S * 8/1975 Sargis ..... D12/189
4,042,975 A * 8/1977 Elliott et al. ..... 2/19
4,054,375 A * 10/1977 Ribeca ..... 359/842
D262,494 S * 12/1981 Pokorny ..... D28/64.2
D278,384 S * 4/1985 Wilson ..... D2/614
4,590,625 A * 5/1986 Keim ..... 2/161.3
4,691,387 A * 9/1987 Lopez ..... 2/161.3
4,747,163 A * 5/1988 Dzierson ..... 2/161.1
4,863,239 A * 9/1989 Malone ..... 359/879
4,945,571 A * 8/1990 Calvert ..... 2/467
5,214,799 A * 6/1993 Fabry ..... 2/161.6
5,257,418 A * 11/1993 Jaskiewicz ..... 2/20
5,361,169 A * 11/1994 Deal ..... 359/838
5,373,584 A * 12/1994 Parcells, III ..... 2/465
5,500,956 A * 3/1996 Schulkin et al. ..... 2/161.1
5,530,588 A * 6/1996 Vivier ..... 359/517
5,557,803 A * 9/1996 Granich et al. ..... 2/16
5,581,809 A * 12/1996 Mah ..... 2/20
5,640,712 A * 6/1997 Hansen et al. ..... 2/20
5,694,261 A * 12/1997 Deal ..... 359/879
5,706,521 A * 1/1998 Haney ..... 2/160
5,819,312 A * 10/1998 Snyder et al. ..... 2/16
5,896,584 A * 4/1999 Hauser ..... 2/161.1
5,898,938 A * 5/1999 Baylor et al. ..... 2/20
D414,151 S * 9/1999 Paquette, Jr. ..... D12/188
6,006,357 A * 12/1999 Mead ..... 2/160
6,044,493 A * 4/2000 Post ..... 2/167
D424,783 S * 5/2000 Meier ..... D2/614

(Continued)

*Primary Examiner* — Alissa L Hoey
(74) *Attorney, Agent, or Firm* — patenttm.us

(57) ABSTRACT

A glove has a body, a side mirror pad and a side mirror. The body has a palm segment having a palm back surface and a wrist segment connected to the palm segment. The side mirror pad is connected to the palm back surface of the palm segment of the body and has a mirror face, a securing end and a connecting end. The securing end is connected to the palm back surface of the palm segment of the body. The connecting end is selectively connected detachably to the securing end and the palm back surface of the palm segment. The side mirror is mounted on the mirror face of the side mirror pad.

15 Claims, 5 Drawing Sheets

U.S. PATENT DOCUMENTS 6,098,200 A * 8/2000 Minkow et al. ..... 2/161.1
6,099,936 A * 8/2000 Kashihara ..... 428/141
6,105,162 A * 8/2000 Douglas et al. ..... 2/20
6,120,157 A * 9/2000 Westover ..... 359/871
6,209,138 B1 * 4/2001 Kang ..... 2/167
6,216,276 B1 * 4/2001 Eibert ..... 2/161.2
6,289,517 B1 * 9/2001 Minkow et al. ..... 2/161.1
6,618,860 B1 * 9/2003 Sullivan et al. ..... 2/159
6,766,536 B1 * 7/2004 Aarons ..... 2/161.3
6,845,514 B1 * 1/2005 Yao ..... 2/16
6,845,519 B2 * 1/2005 Garneau ..... 2/161.1
6,892,397 B2 * 5/2005 Raz et al. ..... 2/160
7,000,253 B1 * 2/2006 Kleinert ..... 2/20
7,000,259 B2 * 2/2006 Matechen ..... 2/161.1
7,140,046 B2 * 11/2006 Ono et al. ..... 2/161.5
7,152,248 B2 * 12/2006 Ziemer ..... 2/160
D536,522 S * 2/2007 McIntosh ..... D3/215
7,254,840 B2 * 8/2007 Hammons et al. ..... 2/16
7,383,591 B1 * 6/2008 Getzwiller et al. ..... 2/161.1
D631,613 S * 1/2011 Yang ..... D29/117.2
7,937,773 B1 * 5/2011 Kleinert ..... 2/161.1
D640,446 S * 6/2011 Allen ..... D2/614
2003/0188373 A1 * 10/2003 Garneau ..... 2/161.1
2004/0025224 A1 * 2/2004 Albert ..... 2/159
2005/0034212 A1 * 2/2005 Eisenbraun ..... 2/159
2006/0007672 A1 * 1/2006 Benson et al. ..... 362/103
2006/0092624 A1 * 5/2006 Park ..... 362/103
2006/0146517 A1 * 7/2006 Park ..... 362/103
2006/0195968 A1 * 9/2006 Powell et al. ..... 2/161.1
2008/0130270 A1 * 6/2008 Carmouche ..... 362/103
2008/0259477 A1 * 10/2008 Gorton et al. ..... 359/879
2009/0034102 A1 * 2/2009 Bartlett ..... 359/879
2009/0168407 A1 * 7/2009 Wright ..... 362/103
2009/0219709 A1 * 9/2009 Chen ..... 362/103
2009/0323316 A1 * 12/2009 Matheney et al. ..... 362/103
2010/0033858 A1 * 2/2010 Weech ..... 359/879
2011/0235310 A1 * 9/2011 Chen ..... 362/103
2011/0258753 A1 * 10/2011 Jacque ..... 2/160

* cited by examiner

GLOVE

BACKGROUND OF THE INVENTION

1. Field of the Invention

The present invention relates to a glove, and more particularly to a glove that can provide multiple functions and is versatile in use.

2. Description of Related Art

A bicycle or motorcycle rider always wears a pair of gloves on to protect and keep hands clean or warm. However, a conventional glove only has a single function but cannot provide additional functions to the user, so the conventional glove is not versatile in use.

Additionally, to ride bicycle or motorcycle for a long distance, a rider always has the following needs.

1. Side mirrors. Although a bicycle or motorcycle has two side mirrors mounted on two sides or ends of a handle, but to adjust angles of the side mirrors is inconvenient.

2. Additional lights. Although a bicycle or motorcycle has a headlight, but the rider cannot turn the light emitted from the head light to any desired angle while riding. The headlight of the bicycle or motorcycle is not versatile in use.

3. Cushions. To improve comfort of holding a handlebar of a bicycle or motorcycle, a conventional glove may have a cushion mounted securely on the glove. However, the conventional cushion is mounted securely on the glove, so the conventional cushion cannot be detached from the glove for different needs.

To overcome the shortcomings, the present invention tends to provide a glove to mitigate or obviate the aforementioned problems.

SUMMARY OF THE INVENTION

The main objective of the invention is to provide a glove that can provide multiple functions.

The glove has a body, a side mirror pad and a side mirror. The body has a palm segment having a palm back surface and a wrist segment connected to the palm segment. The side mirror pad is connected to the palm back surface of the palm segment of the body and has a mirror face, a securing end and a connecting end. The securing end is connected to the palm back surface of the palm segment of the body. The connecting end is selectively connected detachably to the securing end and the palm back surface of the palm segment. The side mirror is mounted on the mirror face of the side mirror pad.

Other objects, advantages and novel features of the invention will become more apparent from the following detailed description when taken in conjunction with the accompanying drawings.

DETAILED DESCRIPTION OF PREFERRED EMBODIMENT

Figure 1:
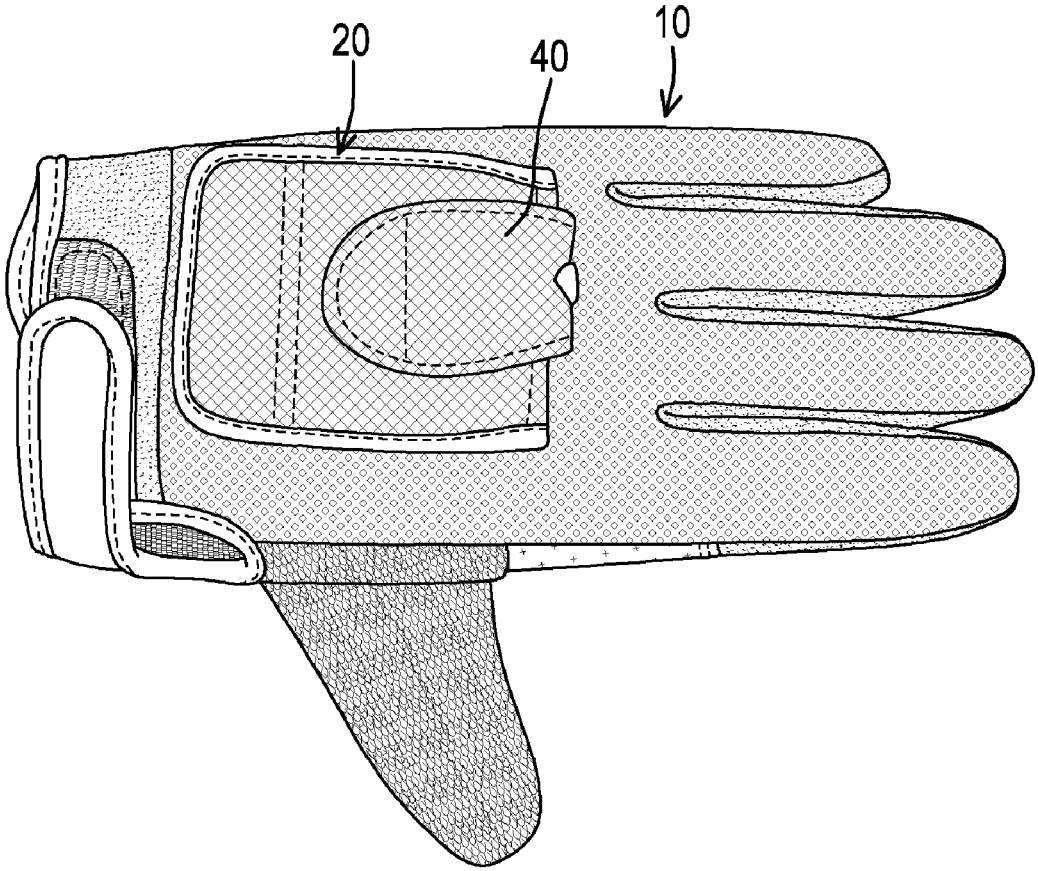
FIG. 1 is a top view of a glove in accordance with the present invention.
Figure 2:
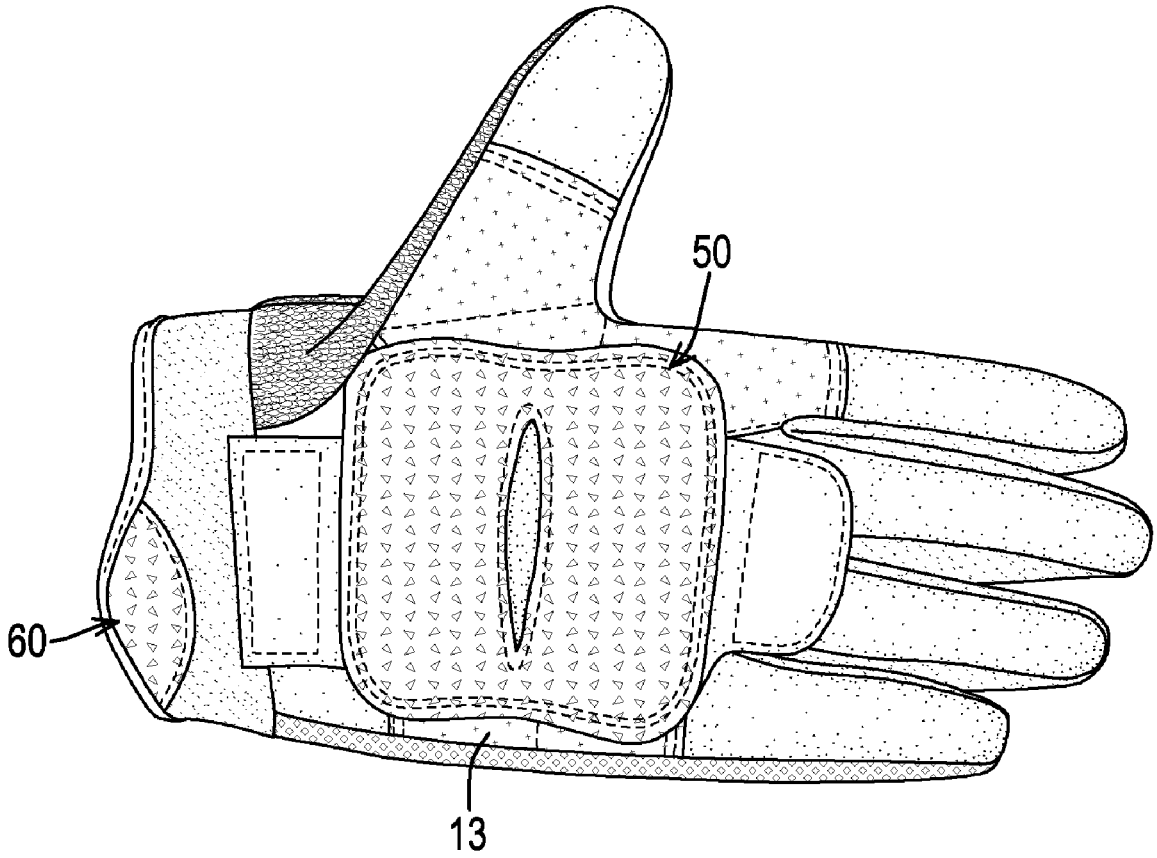
FIG. 2 is a bottom view of the glove in FIG. 1.

With reference to FIGS. 1 to 4, a glove in accordance with the present invention comprises a body 10, a side mirror pad 20, a side mirror 30, an LED assembly 40 and a palm cushion 50.

The body 10 comprises a palm segment, a wrist segment 17 and may have a finger segment 15 and a wrist cushion 60. The palm segment has a palm back surface 11 and a palm inner surface 13 opposite to the palm back surface 11. The wrist segment 17 is connected to one end of the palm segment. The finger segment 15 is connected to the palm segment at an end opposite to the wrist segment 17. The wrist cushion 60 is mounted on the wrist segment 17 and having a skid-proof face 61 provided with multiple skid-proof protrusions. With the arrangement of the wrist cushion 60, a shock-absorbing effect is provided, and the user can wear the glove conveniently by pulling the wrist cushion 60.

The side mirror pad 20 is connected to the palm back surface 11 of the palm segment of the body 10 and has a mirror face 25, an inner face, a middle, a securing end 21 and a connecting end 23. The side mirror pad 20 has a length substantially twice that of the palm segment of the body 10 and can be stood and folded.

The mirror face 25 may be opposite or face to the palm back face 11 of the palm segment of the body 10. The inner face is opposite to the mirror face 25. In the preferred embodiment, the mirror face 25 is opposite to the palm back face 11 of the palm segment of the body 10, and the inner face faces to the palm back surface 11.

The securing end 21 is connected to the palm back surface 11 of the palm segment of the body 10. Preferably, the securing end 21 is connected securely to the palm back surface 11 of the palm segment with sewing at a position adjacent to the wrist segment 17 of the body 10.

The connecting end 23 is selectively connected detachably to the palm back surface 11 of the palm segment at a stood condition and to the securing end 21 at a folded condition. Preferably, the connecting end 23 is connected detachably to the palm back surface 11 of the palm segment at a position at an end opposite to the wrist segment 17 or adjacent to the finger segment 15. To detachably connect the connecting end 23 to the palm back surface 11, a female connector 111 is mounted on the palm back surface 11 at a position adjacent to the finger segment 15. A connecting male connector 2B is mounted on the mirror face 25 at the connecting end 23 and is selectively connected detachably to the female connector 111 on the palm segment.

To detachably connect the connecting end 23 with the securing end 21, a securing female connector 2D is mounted on the mirror face 25 at the securing end 21 and is selectively connected with the connecting male connector 2B on the connecting end 23. The male and female connectors 111,2B, 2D may be adhesive connectors or hook and loop fasteners, such as Velcro straps or the like. Alternatively, the connectors 111,2B,2D may be buttons or the like.

Figure 5:
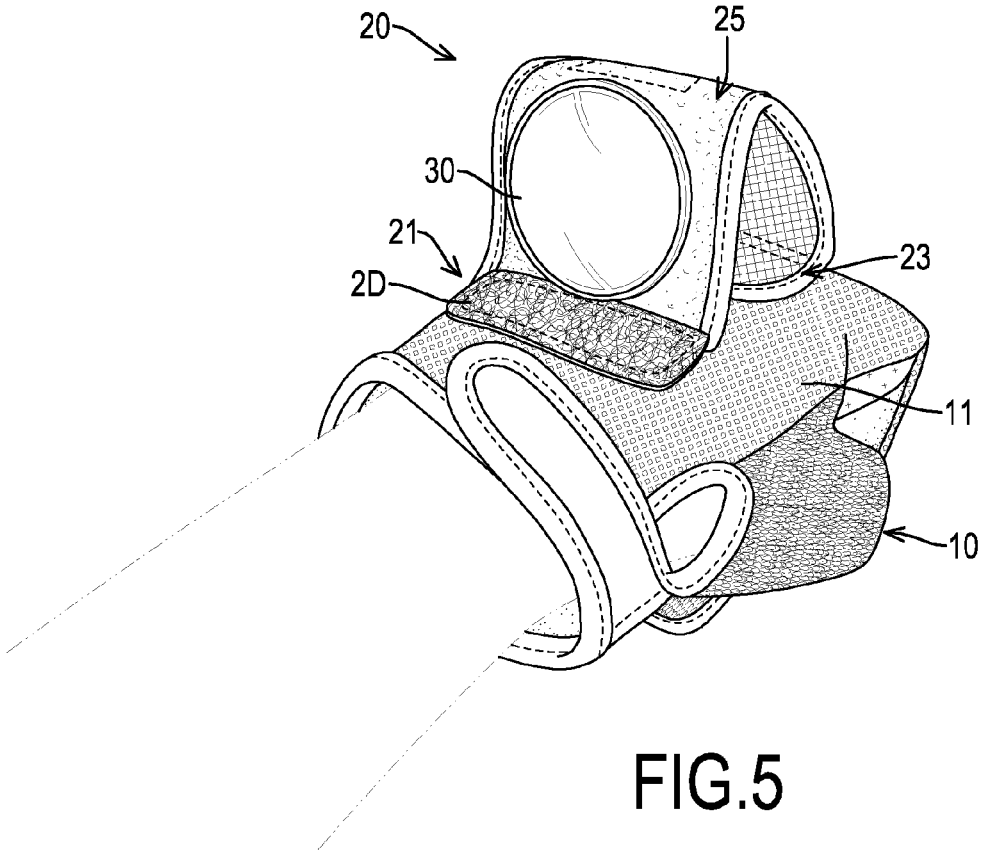
FIG. 5 is an operational perspective view of the glove in FIG. 1 in a using condition.

The middle is foldable and is defined between the securing end 21 and the connecting end 23, such that the side mirror pad 20 can be stood as a triangular form as shown in FIG. 5. In addition, a mounting male connector 29 is mounted on the inner face at a position adjacent to the foldable middle and is selectively connected with the female connector 111 on the palm segment of the body 10 to connect the middle of the side mirror pad 20 onto the body 10 when the side mirror pad 20 is folded.

The side mirror 30 is mounted on the mirror face 25 of the side mirror pad 20. Preferably, the side mirror 30 is mounted detachably on the mirror face 25 of the side mirror pad 20, and the side mirror 30 faces to the wrist segment 17 when the side mirror pad 20 is at a stood condition as shown in FIG. 5. To detachably mount the side mirror 30 on the side mirror pad 20, a male connector and a female connector are mounted respectively on the side mirror 30 and the mirror face 25 of the side mirror pad 20.

The LED assembly 40 is connected detachably to the side mirror pad 20 and may be mounted at the inner face of the side mirror pad 20. To detachably mount the LED assembly 40 on the side mirror pad 20, the side mirror pad 20 further has a light connector 27 mounted on the inner face at a position between the connecting end 23 and the foldable middle of the side mirror pad 20. A corresponding connector is mounted on the LED assembly 40 to connect with the light connector 27 on the side mirror pad 20.

The palm cushion 50 is mounted detachably on the palm inner surface of the palm segment of the body 10 with connectors. The palm cushion 50 comprises two cushion pads 51 and a separating recess 52. The cushion pads 51 are mounted in the palm cushion 50. The separating recess 51 may be eye-shaped and is formed in the palm cushion 50 at a position between the cushion pads 51 to make the palm cushion 50 bendable and foldable. The palm cushion 50 further has a skid-proof face 511 opposite to the palm inner face 13 of the palm segment of the body 10 and having multiple skid-proof protrusions formed on the skid-proof face 511 at positions corresponding to the cushion pads 51.

Figure 3:
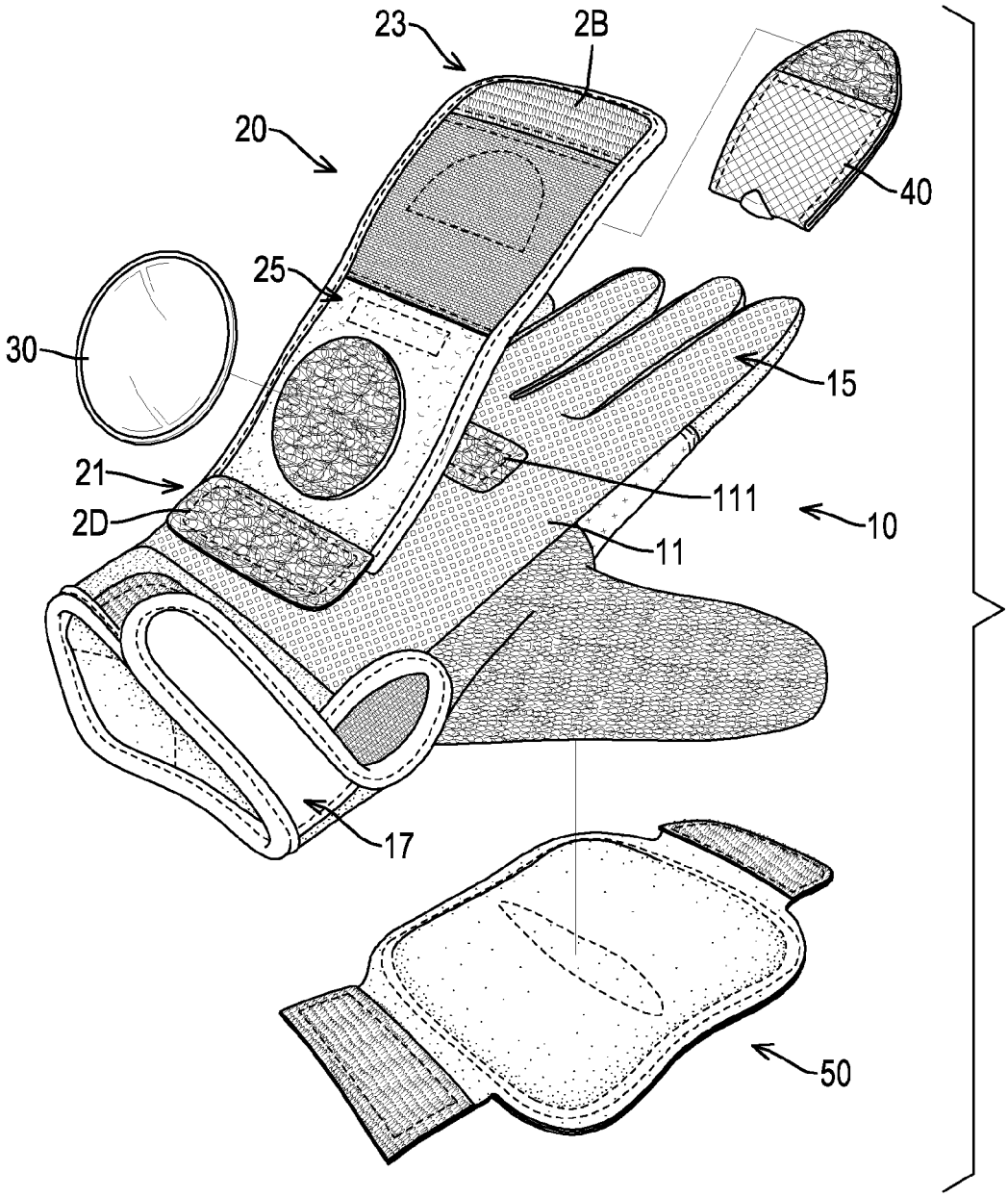
FIG. 3 is an exploded perspective view of the glove in FIG. 1.
Figure 4:
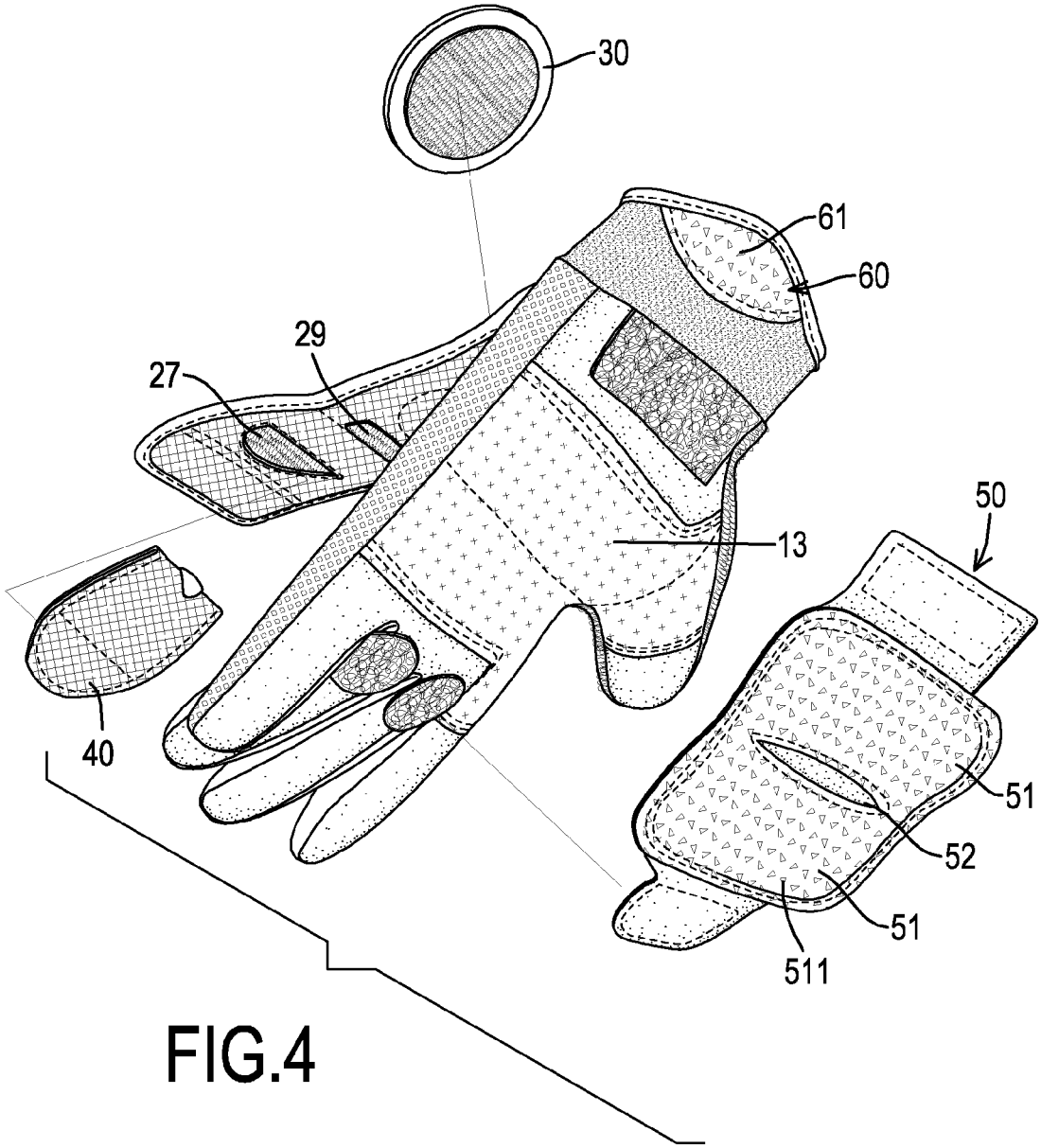
FIG. 4 is another exploded perspective view of the glove in FIG. 1.

In use, with reference to FIGS. 3 to 5, the side mirror pad 20 is stood to a stood condition with the connecting male connector 2B engaging the female connector 111 to face the side mirror 30 to the user and to allow the user to notice backward conditions with the side mirror 30. Because the side mirror 30 is connected to the body 10 that is worn on a hand of the user, the user can adjust the angle of the side mirror 30 easily and conveniently. Additionally, with the detachable connection between the side mirror 30 and the side mirror pad 20, the side mirror 30 can be detached from the side mirror pad 20 when the glove is washing or the user wants to use the mirror 30 in different ways. A worn off or broken mirror 30 is also easily replaced with a new one.

When the glove or the side mirror 30 is not in use, the side mirror pad 20 can be folded with connecting the connecting male connector 2B on the connecting end 23 with the securing female connector 2D on the securing end 21 of the side mirror pad 20. Consequently, the side mirror pad 20 can be folded to a folded condition as shown in FIG. 1, and the glove is easily stored and the side mirror 30 can be kept from being worn off or broken.

With the arrangement of the LED assembly 40, an auxiliary illuminating effect is provided and the direction of the light emitted from the LED assembly 40 can be easily and conveniently adjusted according to needs of the user. The LED assembly 40 can be also detached from the side mirror pad 20 to allow the glove being washed or a powered-off LED assembly 40 being replaced with a new one.

Furthermore, the cushion pads 51 of the palm cushion 50 may be air cushion pads and be made of TPU (Thermoplastic Polyurethane), so that an excellent shock-absorbing effect is provided to improve comfort of riding a bicycle or motorcycle for a long distance. Because the palm cushion 50 is detachably connected to the body 10, the user can detach the palm cushion 50 from the body 10 when the user has specific needs, such as the user rides a bicycle or motorcycle for climbing. With the palm cushion 50 being detached from the body 10, the user easily applies force to grip the handlebar of the bicycle of motorcycle at such those specific conditions.

Additionally, with the separating recess 52, the palm cushion 50 can be bent or folded to fit the shape of the hand of the user for holding handlebar. With the skid-proof protrusions on the skid-proof face 511, the user can hold the handlebar tightly.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A glove comprising:

a body comprising a palm segment having a palm back surface; and a wrist segment connected to the palm segment;

a side mirror pad connected to the palm back surface of the palm segment of the body and having a mirror face;

a securing end connected to the palm back surface of the palm segment of the body;

a connecting end selectively connected detachably to the securing end and the palm back surface of the palm segment; and a foldable middle defined between the securing end and the connecting end to make the side mirror pad at a stood condition when the connecting end is connected to the palm back surface; and a side mirror mounted on the mirror face of the side mirror pad, wherein the palm segment has a female connector mounted on the palm back surface at a position opposite to the wrist segment; and the side mirror pad has a connecting male connector mounted on the mirror face at the connecting end and selectively connected detachably to the female connector on the palm segment;

a securing female connector mounted on the mirror face at the securing end and selectively connected with the connecting male connector on the connecting end; and a mounting male connector mounted on the inner face at a position adjacent to the foldable middle and selectively connected with the female connector on the palm segment of the body.

2. The glove as claimed in claim 1, wherein the body further has a finger segment connected to the palm segment;

the securing end of the side mirror pad is connected securely to the palm back surface of the palm segment of the body at a position adjacent to the wrist segment of the body;

the connecting end of the side mirror pad is connected detachably to the palm back surface of the palm segment at a position adjacent to the finger segment;

the mirror face of the side mirror pad is opposite to the palm back surface of the palm segment of the body; and the side mirror pad has an inner face facing the palm back surface of the palm segment of the body.

3. The glove as claimed in claim 2, wherein the side mirror is mounted detachably on the mirror face of the side mirror pad.

4. The glove as claimed in claim 3, wherein the side mirror pad further has a light connector mounted on the inner face at a position between the connecting end and the foldable middle of the side mirror pad; and an LED assembly is connected detachably to the light connector on the inner face of the side mirror pad.

5. The glove as claimed in claim 4, wherein the palm segment of the body has a palm inner surface opposite to the palm back surface; and the glove further has a palm cushion mounted detachably on the palm inner surface of the palm segment of the body.

6. The glove as claimed in claim 5, wherein the palm cushion comprises two cushion pads mounted in the palm cushion;

a separating recess formed in the palm cushion at a position between the cushion pads; and a skid-proof face opposite to the palm inner face of the palm segment of the body and having multiple skid-proof protrusions formed on the skid-proof face at positions corresponding to the cushion pads.

7. The glove as claimed in claim 6, wherein the body further has a wrist cushion mounted on the wrist segment and having a skid-proof face provided with multiple skid-proof protrusions.

8. The glove as claimed in claim 1, wherein the side mirror is mounted detachably on the mirror face of the side mirror pad.

9. The glove as claimed in claim 1, wherein the side mirror pad further has a light connector mounted on a face that is opposite to the mirror face at a position between the connecting end and the foldable middle of the side mirror pad; and an LED assembly is connected detachably to the light connector on the side mirror pad.

10. The glove as claimed in claim 1, wherein the palm segment of the body has a palm inner surface opposite to the palm back surface; and the glove further has a palm cushion mounted detachably on the palm inner surface of the palm segment of the body.

11. The glove as claimed in claim 10, wherein the palm cushion comprises two cushion pads mounted in the palm cushion;

a separating recess formed in the palm cushion at a position between the cushion pads; and a skid-proof face opposite to the palm inner face of the palm segment of the body and having multiple skid-proof protrusions formed on the skid-proof face at positions corresponding to the cushion pads.

12. The glove as claimed in claim 1, wherein the body further has a wrist cushion mounted on the wrist segment and having a skid-proof face provided with multiple skid-proof protrusions.

13. A glove comprising:

a body comprising a palm segment having a palm back surface; and a wrist segment connected to the palm segment;

a side mirror pad connected to the palm back surface of the palm segment of the body and having a mirror face;

a securing end connected to the palm back surface of the palm segment of the body;

a connecting end selectively connected detachably to the securing end and the palm back surface of the palm segment; and a foldable middle defined between the securing end and the connecting end to make the side mirror pad at a stood condition when the connecting end is connected to the palm back surface; and a side mirror mounted on the mirror face of the side mirror pad, wherein the body further has a finger segment connected to the palm segment;

the securing end of the side mirror pad is connected securely to the palm back surface of the palm segment of the body at a position adjacent to the wrist segment of the body;

the connecting end of the side mirror pad is connected detachably to the palm back surface of the palm segment at a position adjacent to the finger segment;

the mirror face of the side mirror pad is opposite to the palm back surface of the palm segment of the body;

the side mirror pad has an inner face facing the palm back surface of the palm segment of the body;

wherein the side mirror is mounted detachably on the mirror face of the side mirror pad;

wherein the palm segment has a female connector mounted on the palm back surface at a position adjacent to the finger segment; and the side mirror pad has a connecting male connector mounted on the mirror face at the connecting end and selectively connected detachably to the female connector on the palm segment;

a securing female connector mounted on the mirror face at the securing end and selectively connected with the connecting male connector on the connecting end; and a mounting male connector mounted on the inner face at a position adjacent to the foldable middle and selectively connected with the female connector on the palm segment of the body;

the side mirror pad further has a light connector mounted on the inner face at a position between the connecting end and the foldable middle of the side mirror pad; and an LED assembly is connected detachably to the light connector on the inner face of the side mirror pad, and wherein the palm segment of the body has a palm inner surface opposite to the palm back surface; and the glove further has a palm cushion mounted detachably on the palm inner surface of the palm segment of the body.

14. The glove as claimed in claim 13, wherein the palm cushion comprises two cushion pads mounted in the palm cushion;

a separating recess formed in the palm cushion at a position between the cushion pads; and a skid-proof face opposite to the palm inner face of the palm segment of the body and having multiple skid-proof protrusions formed on the skid-proof face at positions corresponding to the cushion pads.

15. The glove as claimed in claim 14, wherein the body further has a wrist cushion mounted on the wrist segment and having a skid-proof face provided with multiple skid-proof protrusions.

US 8,291,516 B2
7 8

* * * * *